US007410389B2

(12) United States Patent
Holliday

(10) Patent No.: US 7,410,389 B2
(45) Date of Patent: Aug. 12, 2008

(54) BULGE-TYPE COAXIAL CABLE TERMINATION ASSEMBLY

(76) Inventor: Randall A. Holliday, 4360 Augusta Dr., Broomfield, CO (US) 80020

( * ) Notice: Subject to any disclaimer, the term of this patent is extended or adjusted under 35 U.S.C. 154(b) by 0 days.

(21) Appl. No.: 11/262,363

(22) Filed: Oct. 29, 2005

(65) Prior Publication Data

US 2006/0063425 A1 Mar. 23, 2006

Related U.S. Application Data

(63) Continuation-in-part of application No. 10/927,884, filed on Aug. 27, 2004, now Pat. No. 7,188,507.

(51) Int. Cl.
*H01R 9/05* (2006.01)

(52) U.S. Cl. ..... 439/578

(58) Field of Classification Search ..... 439/578, 439/63, 583–585
See application file for complete search history.

(56) References Cited

U.S. PATENT DOCUMENTS

| | | | | |
|---|---|---|---|---|
| 3,296,363 | A | 1/1967 | Laudig et al. | |
| 4,668,043 | A | 5/1987 | Saba et al. | |
| 4,684,201 | A | 8/1987 | Hutter | |
| 4,902,246 | A | 2/1990 | Samchisen | |
| 5,024,606 | A | 6/1991 | Ming Hwa | |
| 5,073,129 | A | 12/1991 | Szegda | |
| 5,127,853 | A | 7/1992 | McMills et al. | |
| 5,469,613 | A | 11/1995 | McMills et al. | |
| 5,470,257 | A | 11/1995 | Szegda | |
| 5,501,616 | A | 3/1996 | Holliday | |
| 5,546,653 | A * | 8/1996 | Tournier et al. | 29/751 |
| 5,586,910 | A | 12/1996 | Del Negro et al. | |
| 5,651,699 | A | 7/1997 | Holliday | |
| 5,667,405 | A | 9/1997 | Holliday | |
| 5,863,220 | A | 1/1999 | Holliday | |
| 5,975,949 | A | 11/1999 | Holiday et al. | |
| 5,997,350 | A | 12/1999 | Burris et al. | |
| 6,089,913 | A | 7/2000 | Holliday | |
| 6,146,197 | A | 11/2000 | Holliday et al. | |
| 6,153,830 | A | 11/2000 | Montena | |
| 6,352,448 | B1 | 3/2002 | Holliday et al. | |
| 6,783,394 | B1 | 8/2004 | Holliday | |
| 6,830,479 | B2 | 12/2004 | Holliday | |
| 6,848,940 | B2 * | 2/2005 | Montena | 439/584 |
| 6,916,200 | B2 * | 7/2005 | Burris et al. | 439/578 |
| 6,935,892 | B2 | 8/2005 | Holliday | |
| 2005/0148236 | A1 * | 7/2005 | Montena | 439/578 |

* cited by examiner

*Primary Examiner*—Jean F. Duverne
(74) *Attorney, Agent, or Firm*—The Reilly Intellectual Property Law Firm, P.C.; John E. Reilly

(57) ABSTRACT

A cable termination assembly is made up of a connector body having a thin-walled outer sleeve with generally convex surface portion toward its entrance end which enables its use with a number of different compression member configurations to effect positive sealed engagement with one end of a cable, exemplary compression members including an inner connector sleeve-engaging wall surface which is of uniform diameter throughout its substantial length, one with a slight concavity at its leading end to facilitate preassembly onto the connector sleeve, and one with a combination of concave and convex surface portions.

31 Claims, 9 Drawing Sheets

BULGE-TYPE COAXIAL CABLE TERMINATION ASSEMBLY

CROSS-REFERENCE TO RELATED APPLICATION

This application is a continuation-in-part of patent application Ser. No. 10/927,884, filed 27 Aug. 2004, now U.S. Pat. No. 7,188,507 for COAXIAL CABLE FITTING AND CRIMPING TOOL by Randall A. Holliday and Robert M. Parker and assigned to the assignee of this invention and incorporated by reference herein.

BACKGROUND AND FIELD OF INVENTION

This invention relates to cable termination assemblies; and more particularly relates to a novel and improved termination assembly for efficiently connecting a coaxial cable to a selected device, such as, the terminal on a cable television set.

Coaxial cables are broadly comprised of inner and outer concentric conductors separated by a dielectric insulator and encased or covered by an outer jacket of a rubber-like material. Numerous end connectors have been devised to effect a secure mechanical and electrical connector to the end of the coaxial cable typically by having the inner conductor and dielectric insulator extend through an inner sleeve of the termination assembly while the outer conductor and jacket are inserted into an annular space between the inner sleeve and outer sleeve. The outer sleeve is then crimped in a radially inward direction to securely clamp the end of the cable within the connector, and a fastener on the opposite end of the connector is then connected to the post or terminal, such as, for example, by a nut on the opposite end of the termination assembly to the inner and outer sleeves, or by a bayonet pin and slot between the connecting members, or by means of a suitable press fit or snap fit connection. Representative termination assemblies or connectors that have been devised for this purpose are disclosed in U.S. Pat. Nos. 5,501,616; 6,089,913 and 5,863,220, all invented by the applicant of this patent application.

As a setting for the present invention, the '616 patent referred to above utilizes serrations along an outer surface of the inner sleeve of the connector and sealing ribs along an inner surface of the outer sleeve and in facing relation to the serrations so as to effect a secure weather-tight seal with the outer conductor and jacket which are inserted between the inner and outer sleeves.

There is a continuing need for a compression-type coaxial cable end connector which is capable of achieving an improved localized mechanical connection between the cable end and connector in response to axial advancement of a crimping ring along the end of the cable-receiving connector end and which is conformable for use in different sizes and types of connectors with a simplified crimping ring which may either be preassembled onto the end of the connector prior to shipment to the field or may be assembled when the crimping operation is to be performed.

SUMMARY OF THE INVENTION

It is therefore an object to provide for a novel and improved compression connector for cables and specifically for coaxial cables. For example, to provide for a novel and improved compression connector capable of effecting improved localized sealed engagement with a cable end in response to axial advancement of a crimping ring while avoiding the necessity of separate seals between the connecting parts; and another example is to provide for a novel and improved coaxial cable compression connector which is conformable for use with different types and sizes of coaxial cables and requires a minimum of force in radially contracting an end of the connector into localized sealed engagement with the cable.

In one embodiment, there has been devised a compression connector for connecting a cable having an electrically conductive member to another electrically conductive member comprising a sleeve member of a generally cylindrical configuration sized for insertion of an end of the cable, the sleeve having an external wall surface portion of generally convex configuration, and compression member having an inner annular surface dimensioned to advance over the sleeve member to engage with the convex surface portion whereupon axial advancement of the crimping means along the sleeve member will impart inward radial deformation to the sleeve member into localized sealed engagement with the cable. In one aspect, the crimping force may be imparted by a crimping tool and in another aspect may be imparted by a compression ring which is either preassembled onto the sleeve member or assembled when it is desired to perform the crimping operation.

In the forms described above, the compression ring either may have an inner annular surface portion of uniform diameter or include either an inner concave or convex surface portion wherein axial advancement of the crimping member along the sleeve member into engagement with the external convex surface portion on the sleeve will impart inward radial deformation to the sleeve member into localized sealed engagement with a cable; or the crimping ring may have an inner annular surface portion made up of a combination of a concave surface portion and convex surface portion.

Especially when used in terminating coaxial cable ends, the connector is provided with inner and outer concentric sleeve members with axially spaced sealing ribs on an inner surface of the outer sleeve adjacent to its entrance end so that when the outer layers of the cable are inserted into the space between the inner and outer sleeve members and a crimping force applied to the outer sleeve will effect localized sealed engagement between the inner sealing ribs and outer layers of the cable in creating the most effective localized sealed engagement along the area of the sealing ribs.

The above and other objects, advantages and features will become more readily appreciated and understood from a consideration of the following detailed description of preferred and modified forms of the present invention when taken together with the accompanying drawings in which:

DETAILED DESCRIPTION

Figures 1, 2:
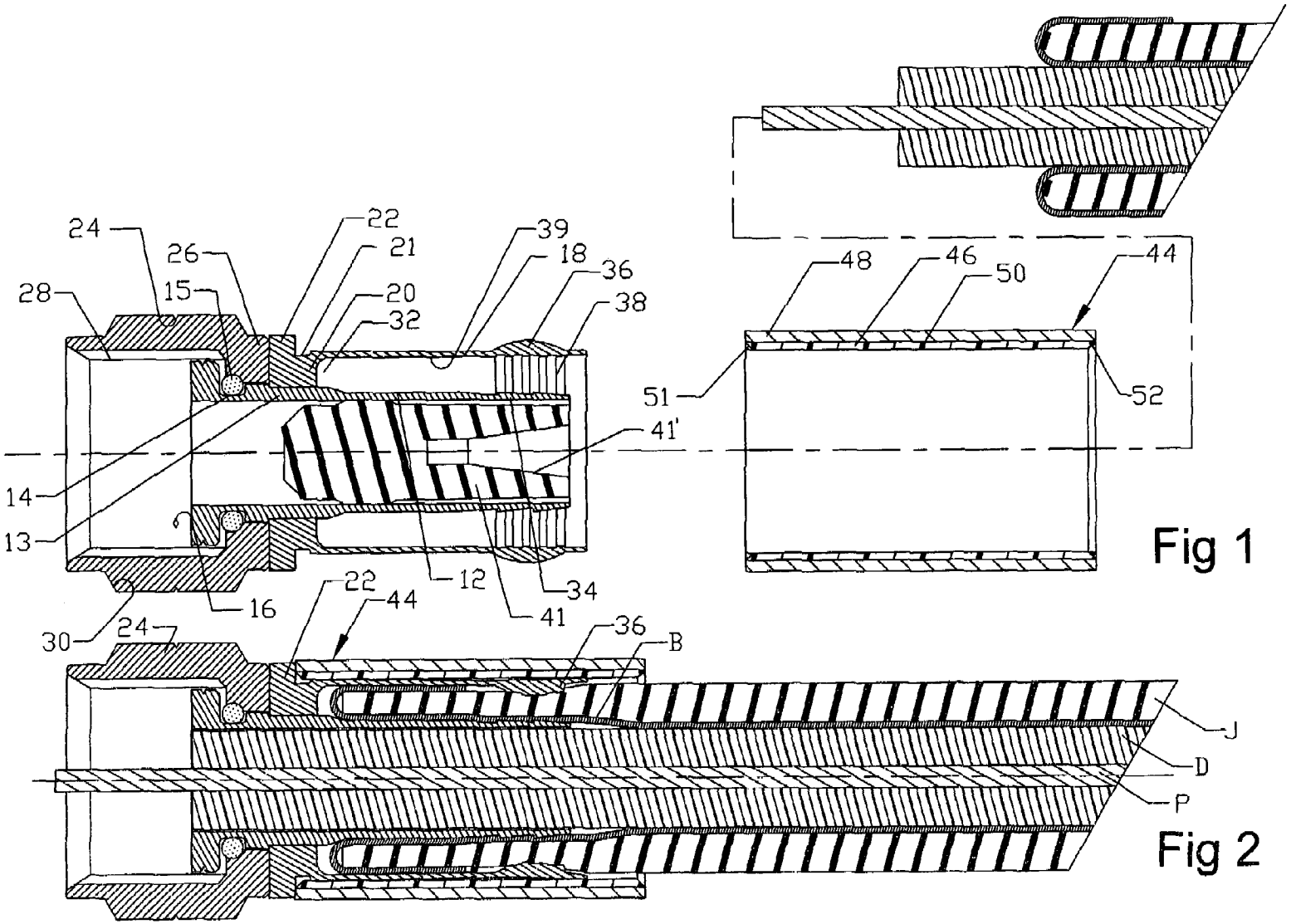
FIG. 1 is a longitudinal section view of one form of connector and illustrating the compression member and cable in the open position prior to assembly.
FIG. 2 is a longitudinal section view of the form shown in FIG. 1 illustrated in the closed position.

Referring in more detail to the drawings, one form of fitting is illustrated in FIGS. 1 and 2 wherein the fitting is made up of an end connector 10 for connecting a first electrically conductive member, such as, a standard coaxial cable C to a second electrically conductive member, such as, a television terminal or terminal on different components of a home entertainment system, not shown. The end connector 10 is broadly comprised of an elongated thin-walled sleeve 12 at an entrance end, the sleeve 12 gradually increasing in thickness along a midportion 13 into an external groove 14 and terminating in an external shoulder 16; and an outer thin-walled sleeve 18 extends from a point slightly beyond the inner wall 12 at the entrance end and increases in thickness to form an annular body 20 in surrounding relation to the midportion 13, the annular body provided with an external groove 21 and which is flanked at one end by a shoulder 22. The connector also includes a fastener 24 having a first end 26 of reduced diameter which is mounted in surrounding relation to the midportion 13 and to an O-ring seal 15 mounted in the groove 14, and the fastener 24 extends rearwardly from the end portion 26 to extend over and beyond the shoulder 16, the fastener being internally threaded as at 28 to facilitate connection to a post or terminal, not shown. An exterior surface 30 of the fastener is provided with suitable flats to permit engagement by a tool for rotation independently of the rest of the connector.

The inner and outer sleeves 12 and 18 extend rearwardly from the entrance end in spaced concentric relation to one another so as to form an annular space 32 therebetween for insertion of a standard cable C in a manner to be described. The inner sleeve 12 is of substantially uniform wall thickness for its greater length and has a plurality of axially spaced, annular serrations 34 along its outer wall surface and toward the entrance end. The outer sleeve 18 is thin-walled along its greater length but gradually increases in thickness to define an external convex surface portion 36 and which has a plurality of axially spaced sealing rings 38, the sealing rings 38 defined by a plurality of axially spaced alternate ribs and grooves in accordance with U.S. Pat. No. 5,501,616. The rings 38 project inwardly from inner wall surface 39 along a limited length of the sleeve 18 in opposed or confronting relation to the serrations 34.

One of the electrically conductive members is defined by the coaxial cable C which is comprised of an inner pin conductor P, dielectric insulator D, outer braided conductor layer B, and a non-conductive outer jacket J. Foil layers, not shown, are interposed between the insulator D and layer B as well as between the braided layer B and the jacket J. The end of the cable C to be inserted into the connector is prepared by removing portions of the insulator D, layer B and jacket J from the end of the cable to expose an end portion of the pin conductor P. A portion of the braided layer B which extends beyond the jacket J is peeled back over a leading end of the jacket J in accordance with conventional practice. Typically, one or more braided layers B are employed depending upon the frequencies to be handled.

In the form illustrated in FIGS. 1 and 2, a compression member in the form of a crimping ring 44 is of generally cylindrical configuration and of a length corresponding to the length of the thin-walled sections of the outer sleeve 18. Preferably, the member 44 is comprised of an inner liner 46 of uniform thickness and diameter throughout which terminates in opposed beveled ends 51 and 52, and an outside band 48 which similarly is of uniform thickness and diameter throughout and is coextensive with the liner 46. The inner liner 46 is composed of a material having a slight amount of give or resilience, such as, a high strength plastic material sold under the trademark "DELRIN®"; and the outer band 48 is composed of a material having little or no give or compressibility, such as, a brass material. The liner 46 and the band 48 are of substantially corresponding thickness, and the liner 46 is mounted in pressfit relation inside of the band 48 with its inner wall surface 50 being of a diameter corresponding to or slightly greater than the outer diameter of the sleeve 18 at its entrance end. The liner 46 has an inner diameter less than the convex surface portion 36 on the outer sleeve so that when the ring 44 is axially advanced over the sleeve will impart inward radial deformation to the convex surface portion causing it to be contracted, as illustrated in FIG. 2, into engagement with the cable C.

Figure 11:
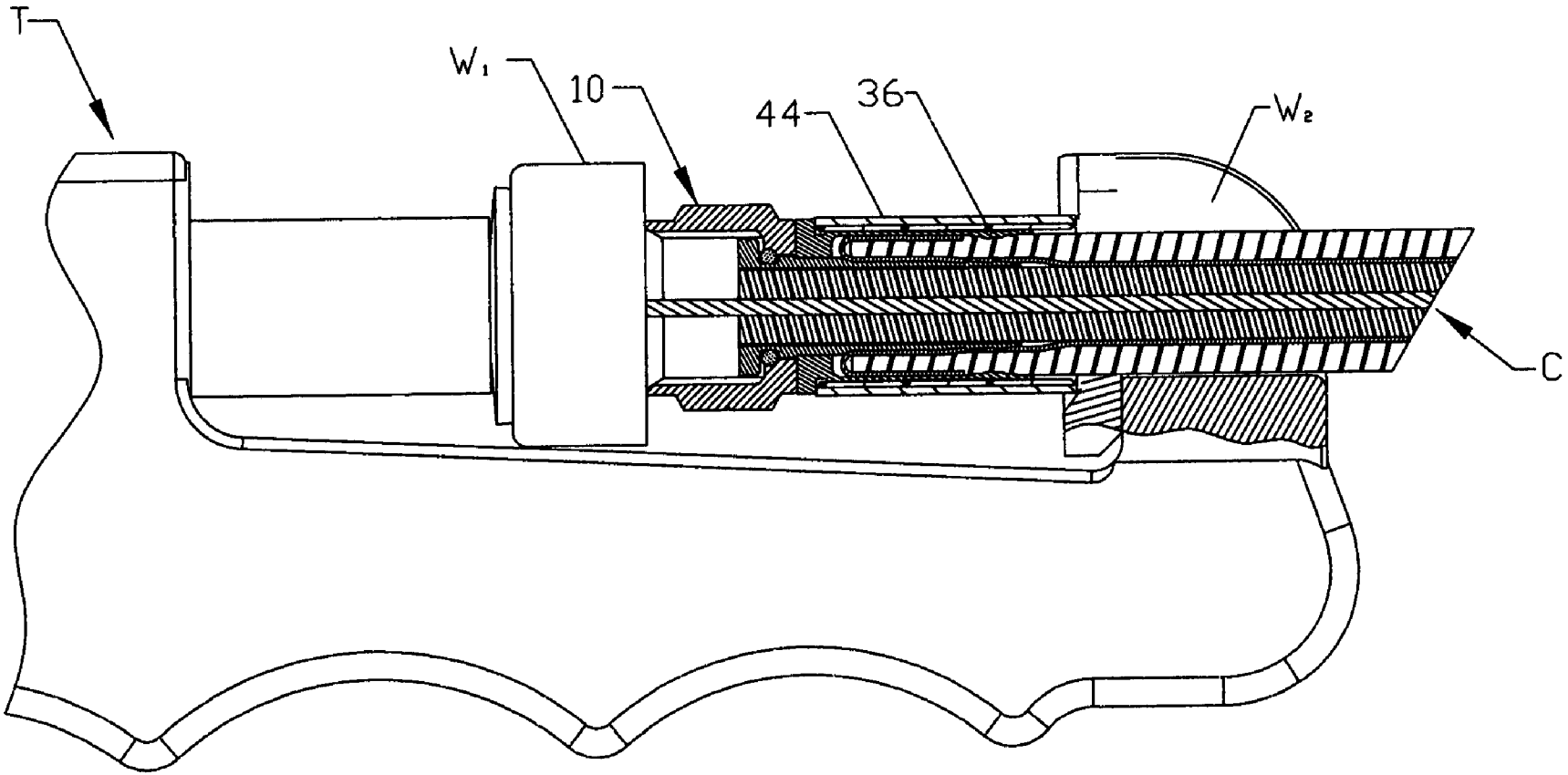
FIG. 11 is a somewhat schematic view of a standard compression tool employed in carrying out the crimping operation on any one of the embodiments illustrated herein.

The cable C is connected to the connector 10 by first preparing the leading end of the cable to fold the braided layer B over the end of the jacket J, as illustrated in FIG. 1. The compression ring 44 is aligned, as illustrated in FIG. 1, with the end of the connector 10, following which the leading end of the cable C is advanced through the compression ring 44 into the annular space 32 between the inner sleeve 12 and outer sleeve 18. In order to facilitate accurate alignment of the end of the cable C with the annular space 32, a starter guide 41, as illustrated in FIG. 1 may be positioned within the central opening of the inner sleeve 12, the starter guide being a snub-nosed member with a tapered opening or socket 41' at one end to guide the exposed end of the pin conductor P into centered relation to the connector body thereby aligning the jacket J and doubled-over end of the braided layer B with the annular space 32. A standard compression tool T, such as, that illustrated in FIG. 11, is provided with jaws $W_1$ and $W_2$ which are spread far enough apart to permit insertion of the assembled connector 10 and compression member 44 between the jaws. A lever arm on the tool, not shown, will impart sufficient axial force in squeezing the jaws $W_1$ and $W_2$ together to advance the compression member 44 over the bulge or convex surface portion 36 whereby to radially deform or contract that portion of the sleeve 18 inwardly so that the portion 36 will be bowed in a radially inward direction, as shown in FIG. 2, and cause the jacket J as well as at least a portion of the braided layer B to be compressed slightly between the inner and outer sleeves 12 and 18. Once the installation is completed, the starter guide 39 may be removed from the end of the pin conductor P and discarded. The compression tool T is shown and described in detail in U.S. Pat. No. 6,708,396 which is incorporated by reference herein.

Figure 3:
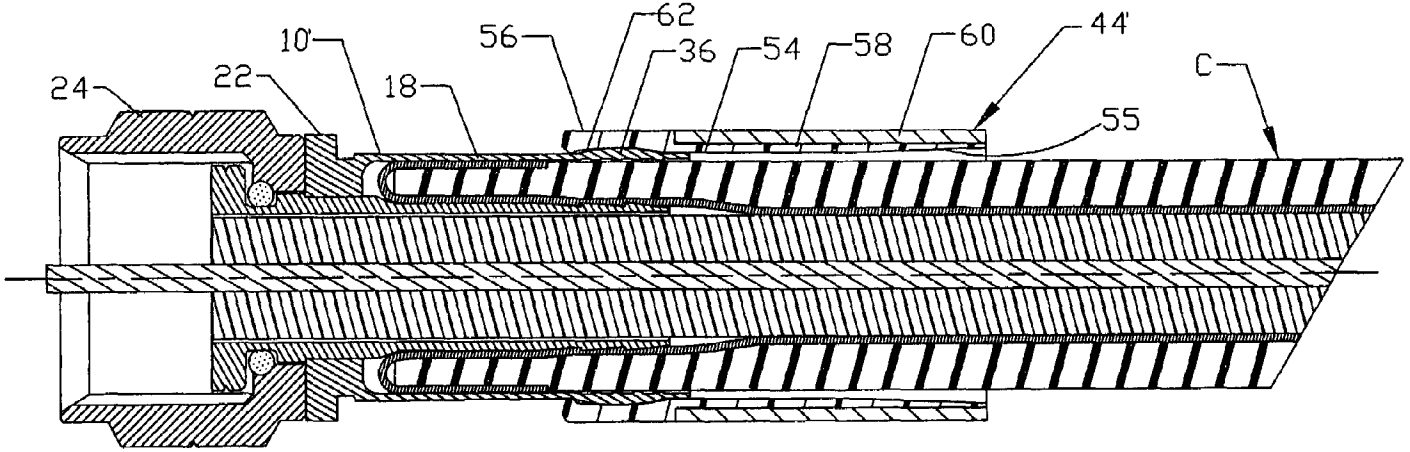
FIG. 3 is a longitudinal section view of another example illustrating the compression member in the open position and preassembled onto the end of a connector body.
Figure 4:
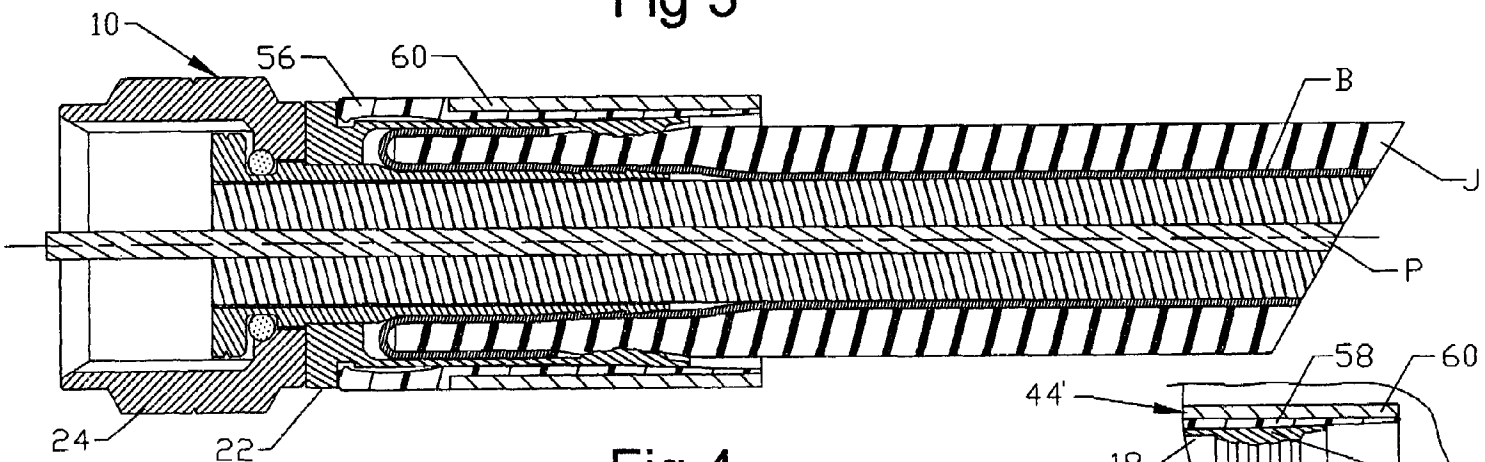
FIG. 4 is a longitudinal section view of the form illustrated in FIG. 3 with the termination assembly shown in the closed position.
Figure 4A:
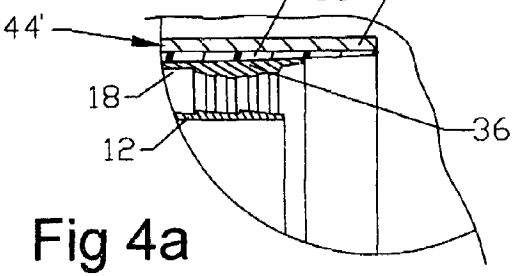
FIG. 4A is an enlarged, fragmentary detailed view of a portion of the entrance end of the connector body shown in FIG. 4.

Another form of termination assembly is illustrated in FIGS. 3, 4 and 4A which illustrates a connector 10 corresponding to the connector 10 of FIGS. 1 and 2 and like parts are correspondingly enumerated. A compression ring 44' is modified somewhat from the compression ring 44 of FIGS. 1 and 2 by the utilization of an inner liner 54 of increased thickness at one end 56 and includes an inset portion 58 over its greater length to receive an outer band 60. The thickened end portion 56 is provided with an inner concave surface portion 62 which is complementary to the convex surface portion 36 on the outer connector sleeve 18 in order to facilitate mounting of the compression ring member 44' onto the end of the connector 10', as illustrated in FIG. 3. Again, the liner 54 is composed of a material having some give or resiliency as in the form of FIGS. 1 and 2 and therefore can be manually advanced into the pre-installed mounting position shown in FIG. 3. The inner liner 54 has an inner surface 55 substantially corresponding in diameter to the external diameter of the connector 18 at its entrance end and will expand slightly as it is passed over the convex surface portion 36, then return to its original diameter after the concave surface portion 62 moves into alignment and flush engagement with the convex surface portion 36. However, under continued axial advancement toward the closed position shown in FIG. 3, the outer band 60 will resist any tendency of the liner 54 to expand as it advances over the convex portion 36 and will impart sufficient force to cause inward radial deformation of the convex surface portion 36 into the reverse convex curvature as shown in FIG. 4.

FIG. 4A illustrates in greater detail the inward radial deformation of the convex surface portion 36 into compressed relation to the outer jacket J of the cable C and, depending upon the length of the doubled-over portion of the braided conductor 106, will compress the braided conductor as well.

Figures 5, 6, 7:
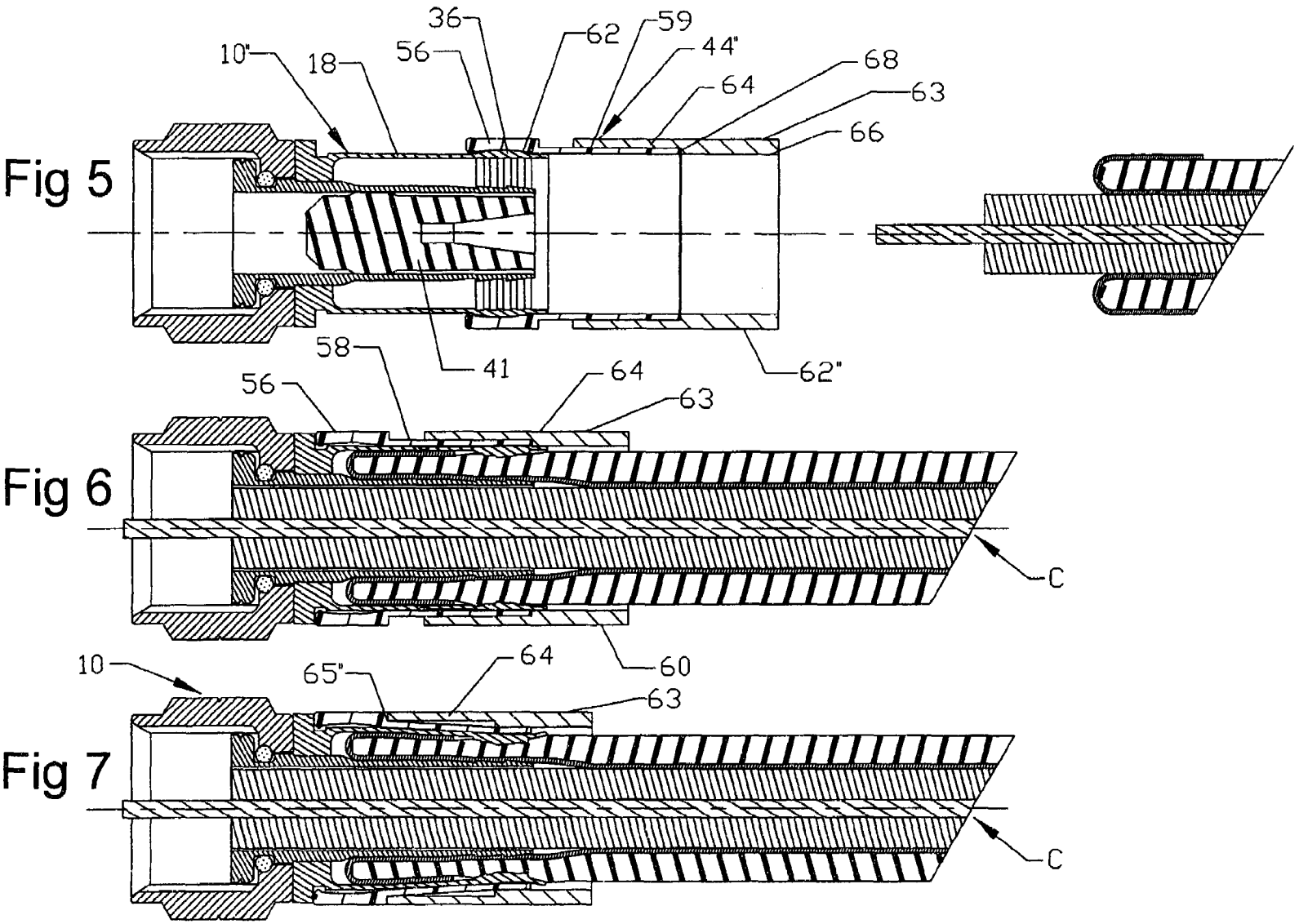
FIG. 5 is a longitudinal section view of another embodiment shown in the preassembled position with a multi-stage compression member.
FIG. 6 is a longitudinal section view of the embodiment shown in FIG. 5 with the compression member shown in a partially closed position.
FIG. 7 is another longitudinal section view of the embodiment shown in FIGS. 5 and 6 with the compression member in the fully closed position.

Another embodiment is illustrated in FIGS. 5 to 7 wherein a connector 10 corresponding to the connector 10 of FIGS. 1 and 2 is utilized with another modified form of compression ring 44". The ring 44" is made up of an inner liner 58 corresponding to the liner 58 of FIGS. 3 and 4 including a thickened portion 56 and an inset portion 59 to receive an outer band 63 which is slidably mounted on the inset portion 59 so as to define a multi-stage compression ring 44". The outer band 63 includes a leading end 64 having an inner diameter corresponding to the outer diameter of the inset portion 59 of the liner 58 and a trailing end portion 66 which is thickened with respect to the leading end 64 and stepped inwardly to be of a reduced inside diameter corresponding to the inner diameter of the liner 58. A shoulder 68 between the leading end 64 and trailing end 66 is beveled somewhat and acts as an initial stop when the band 63 is partially assembled onto the liner 58 as illustrated in FIG. 5.

The leading end 56 is pre-assembled onto the connector 10 by advancing the concave surface portion 62 over the convex surface portion 36 as illustrated in FIG. 5. Continued axial advancement of the liner 58 will cause the leading end portion 56 to advance forwardly toward the closed position as the leading end portion 64 of the band 63 advances over the convex surface portion 36. The increased pressure imparted by the leading end 64 of the band 63 will compress the convex surface portion 36 into engagement with the cable C. Termination is completed by continued advancement of the band 63 over the liner 58 until the band moves into engagement with the external shoulder 65 on the liner. In this way, the inward radial deformation of the convex surface portion 36 and adjacent portions of the outer sleeve 18 is more gradual than that of FIGS. 3 and 4 but results in increased pressure by virtue of the direct application of force by the trailing end 66 of the band moving into engagement with the entrance end of the connector sleeve 18.

Figures 8, 9, 10:
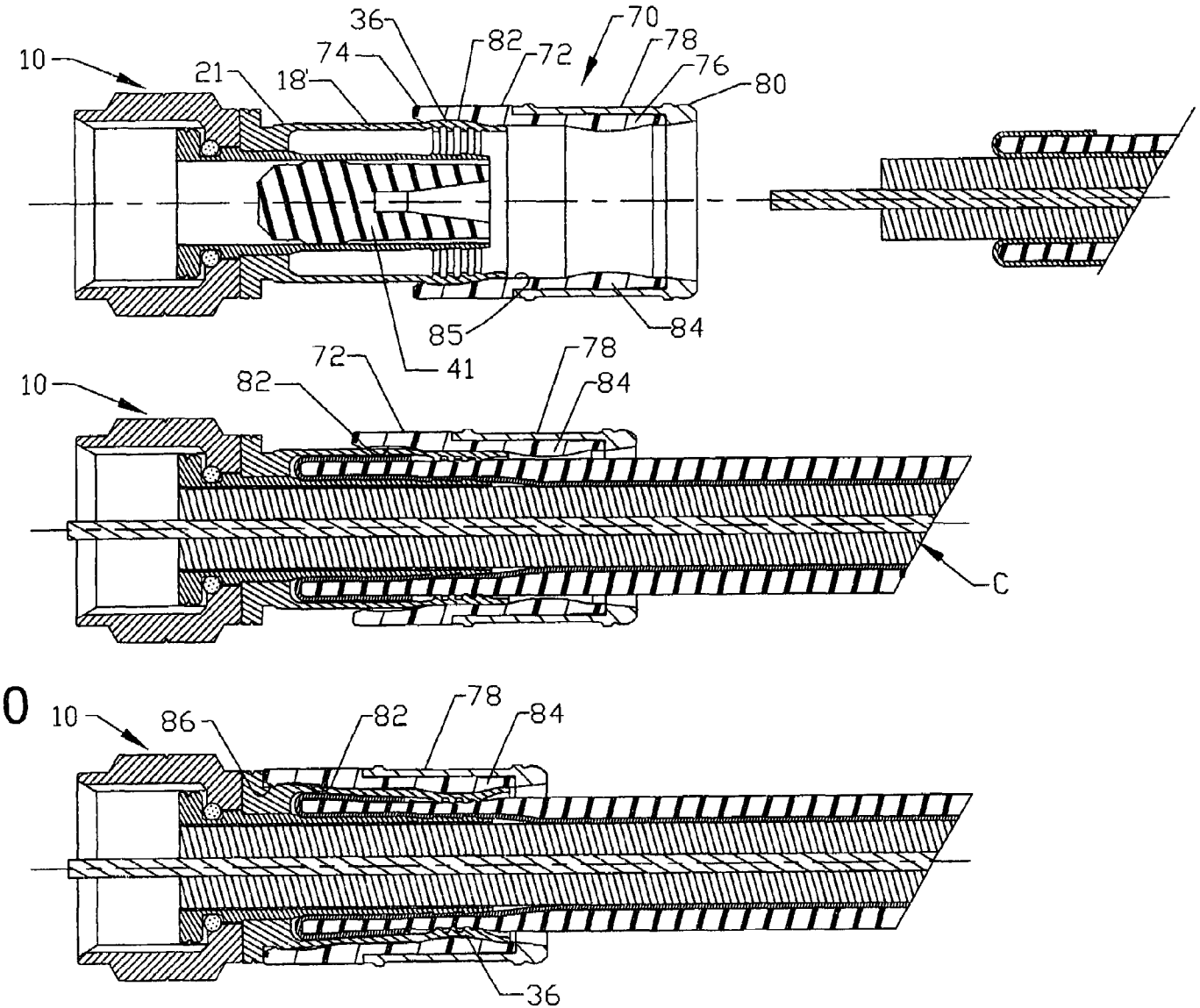
FIG. 8 is a longitudinal section view of still another embodiment with the compression member shown in a preassembled or partially closed position.
FIG. 9 is a longitudinal section view of the form shown in FIG. 8 after compression of the connector has been initiated.
FIG. 10 is a longitudinal section view of the form shown in FIGS. 8 and 9 after completion of the crimping operation and with the compression member advanced to the closed position.

In the form illustrated in FIGS. 8 to 10, a connector 10 corresponding to the connector 10 of the previous embodiments described has like parts correspondingly enumerated to the previous embodiments. One departure from the previous embodiments described is noted with prime numerals and has reference to the slight reduction in diameter of outer connector sleeve 18' toward the entrance end except of course for convex surface portion 36. In addition, a compression member in the form of a crimping ring 70 is comprised of an inner liner 72 made up of a thickened portion 74 and inset portion 76 to receive a band 78 which is mounted in fixed relation to the liner 72 and has a relatively thick trailing end portion 80.

The crimping ring 70 is characterized in particular by having a first concave surface portion 82 along the inner wall surface of the thickened portion 72 which is not covered by the band 78, a second, axially spaced convex surface portion 84 toward its trailing end which is surrounded by the outer band 78, and a uniform diameter surface portion 85. In this way, the leading end 72 may be preassembled onto the connector 10, as illustrated in FIG. 9, by advancing the concave surface portion 82 over the convex surface portion 36 into the partially closed position shown in FIG. 9. Continued axial advancement of the liner 82 causes the inner convex surface portion 84 to traverse the convex surface portion 36 on the connector sleeve 18' to cause the convex surface portion 36 to undergo inward radial contraction into positive engagement with the jacket on the cable C, as illustrated in FIG. 10. The leading end of the liner 74 includes a slight protuberance 86 which will advance into the external groove 21 on the connector body as shown in FIG. 10.

Figure 12:
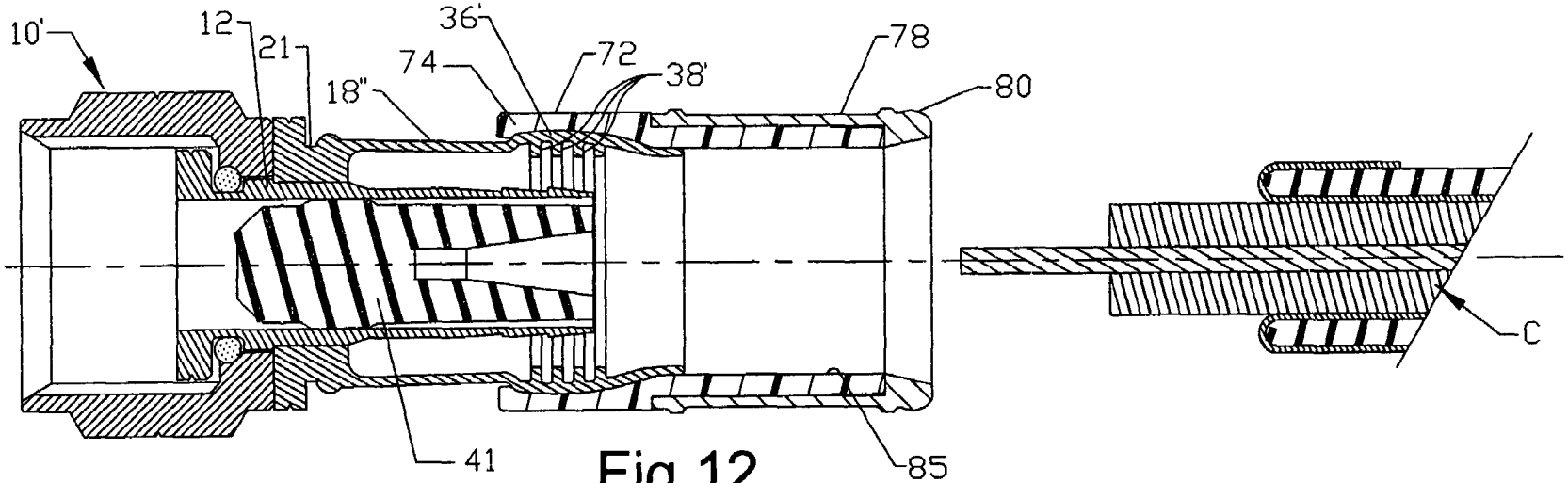
FIG. 12 is a longitudinal section view of another embodiment of a connector body with the compression member shown in a preassembled position on the connector body.
Figure 13:
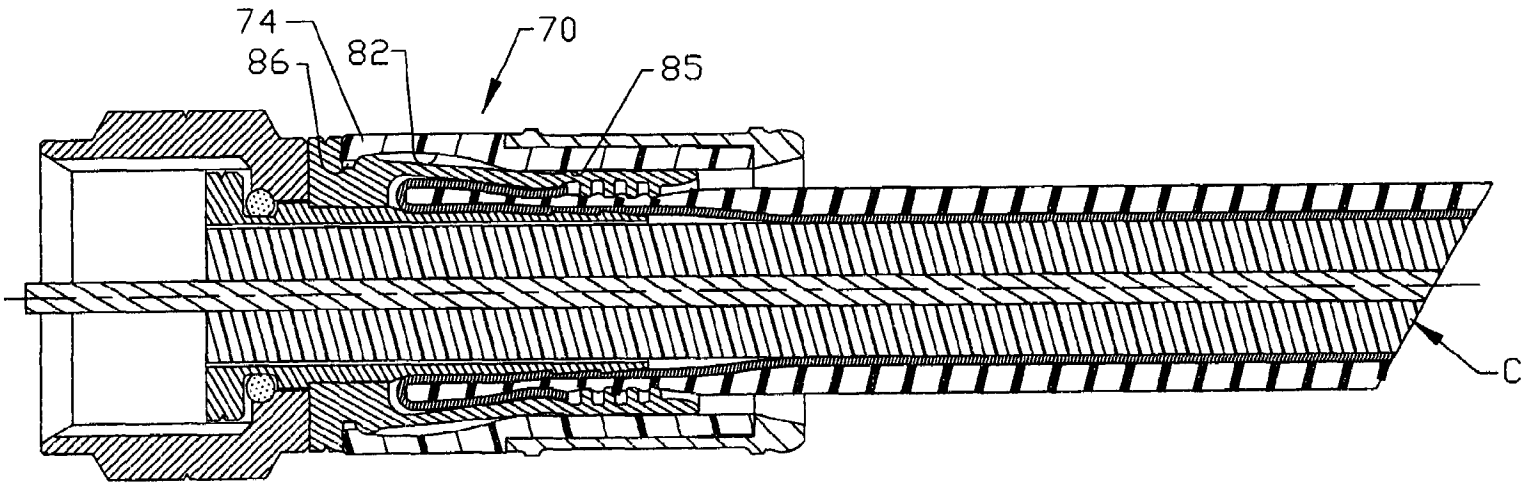
FIG. 13 is a longitudinal section view of the form shown in FIG. 12 in the closed position.

FIGS. 12 and 13 illustrate another application of a bulge type connector body 10' which is basically the same as the connectors 10 of the embodiments described and therefore like parts are correspondingly enumerated; however, the outer thin-walled sleeve 18" is of substantially uniform thickness along its entire length and is bowed outwardly to define a convex portion or bulge at 36' adjacent to its entrance end. In place of the relatively shallow sealing rings 38 of FIGS. 1-10, a plurality of axially spaced ribs 38' of increased depth relative to the sealing rings 38 project radially inwardly along the inner wall surface of the bulge 36' and are of a depth greater than the thickness of the sleeve 18' but will terminate along a uniform diameter and leave sufficient clearance for insertion of a cable C into the body 10' with the outer braided layer B and jacket J extending between the inner and outer sleeves 12 and 18".

A crimping ring 70 corresponds to the crimping ring 70 of FIGS. 8-10 and is therefore correspondingly enumerated, except that the inner convex surface portion 84 is eliminated and the inner surface 85 is of uniform diameter rearwardly from the inner concave surface portion 82. Accordingly, the leading end 72 may be preassembled onto the body 10', as illustrated in FIG. 12, by advancing the portion 82 over the convex portion 36 into the position shown in FIG. 12. Continued advancement of the liner 82 will cause the portion 84 to traverse the portion 36' on the sleeve 18" and force the convex portion 36' and inner ribs 38' into positive engagement with the jacket J as shown in FIG. 13. It will be evident that the degree of imbedment of the ribs 38' is much greater than in the form of FIGS. 8-10 but not so great as to extend all the way through the thickness of the jacket J. The protuberance 86 at the leading end will advance into engagement with the groove 21, as shown in FIG. 13.

Figure 14:
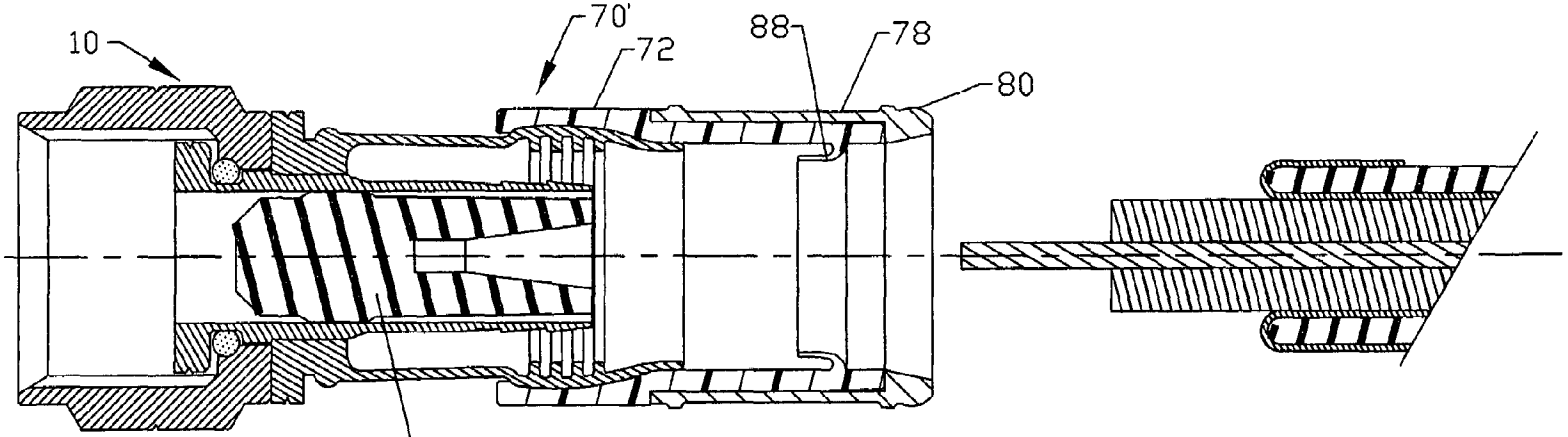
FIG. 14 is a longitudinal section view of the connector body illustrated in FIGS. 11 and 12 with a modified form of compression member shown in the preassembled position.
Figure 15:
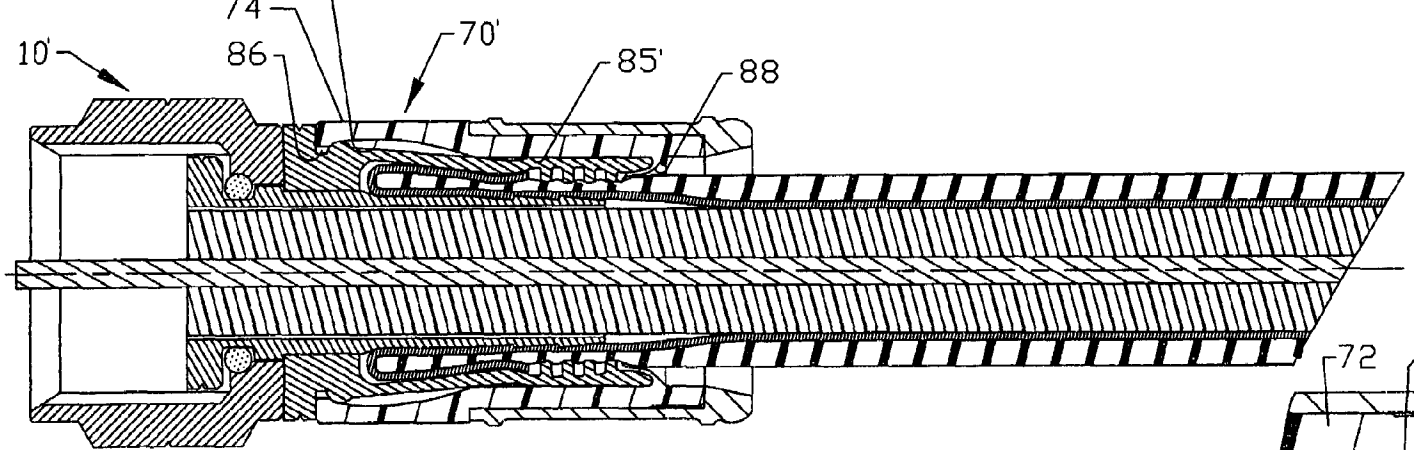
FIG. 15 is a longitudinal section view of the embodiment shown in FIG. 14 illustrated in the closed position.
Figure 15A:
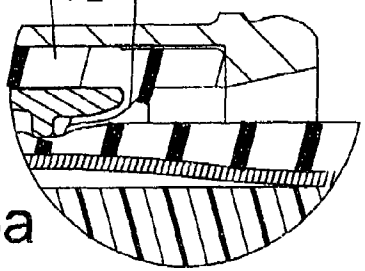
FIG. 15A is an enlarged, fragmentary detailed view of the entrance end of the connector body shown in FIG. 15.

In the embodiment of FIGS. 14, 15 and 15A, the connector body 10' of FIGS. 12 and 13 is utilized with a modified form of compression ring 70' which corresponds with that of FIGS. 12 and 13 but incorporates an annular spacer or rib 88 adjacent to the trailing end portion 80 of the liner 72. As in the other embodiments, the liner 72 is composed of a plastic material having limited resiliency and compressibility. The spacer 88 has the same properties and therefore will bend slightly when the cable is inserted into the body 10'. When the compression member 70' is advanced over the sleeve 18' toward the closed position, as best seen from FIG. 4A, the spacer 88 will form a seal between the entrance end of the sleeve 18' and the jacket J and will resist any tendency of the entrance end of the sleeve 18' to engage or penetrate the jacket J. Although not readily discernible, the entrance end of the sleeve will flare outwardly against the liner 72 in response to the compression of the convex portion 36' and inner ribs 38' into the jacket J.

Figure 16:
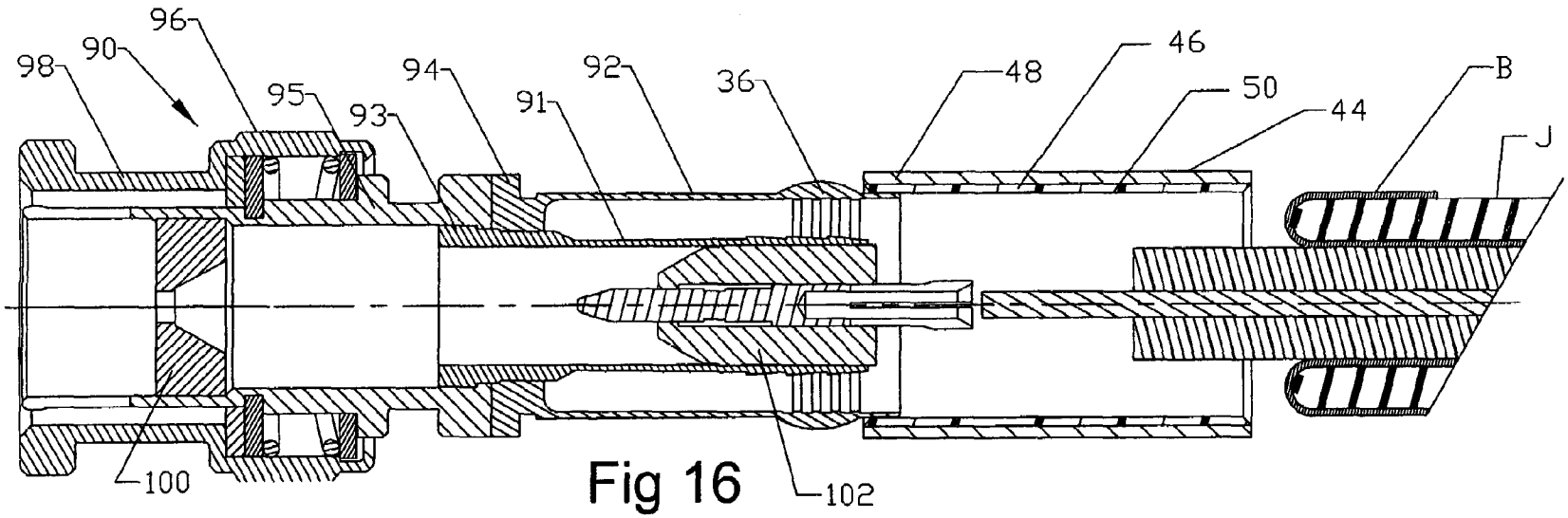
FIG. 16 is a longitudinal section view of still another embodiment having a BNC connector body and the compression member shown in a preassembled position with respect to the body.
Figure 17:
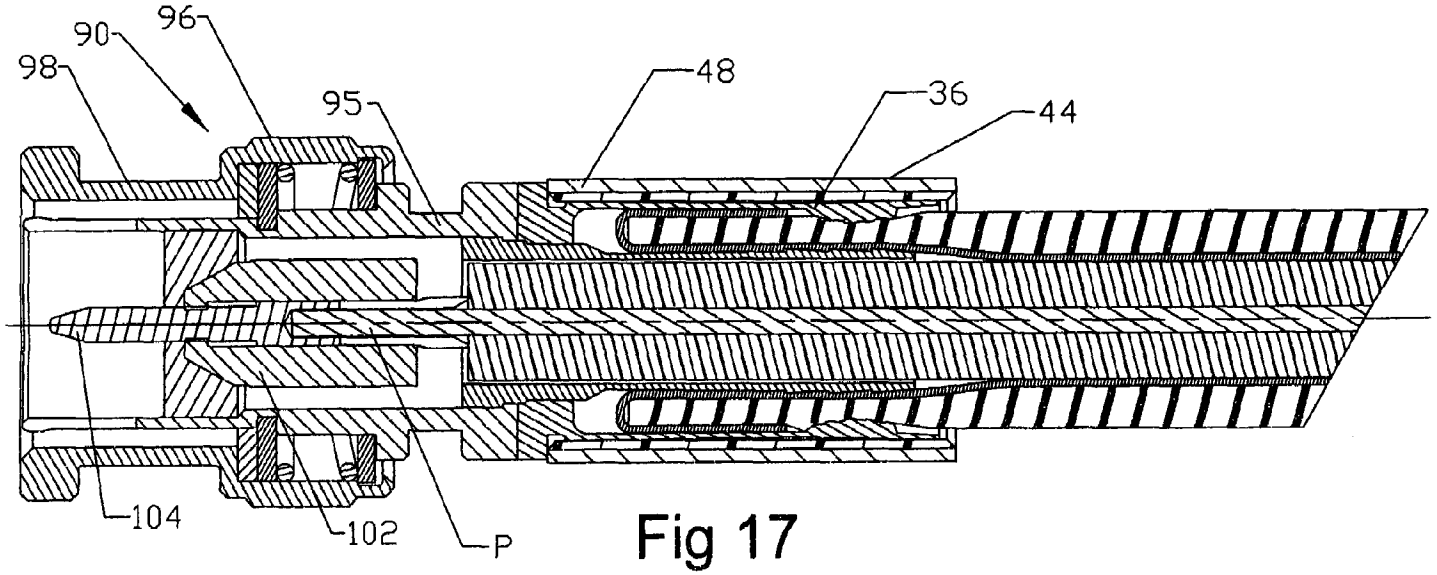
FIG. 17 is a longitudinal section view of the embodiment shown in FIG. 16 illustrated in the closed position.

By way of illustration but not limitation, there is shown in FIGS. 16 and 17 a standard BNC connector body 90 having spaced inner and outer concentric sleeves 91 and 92, the inner sleeve 91 terminating in an annular mounting flange 93 at one end and the outer sleeve 92 terminating in an external shoulder 94 which is mounted on the flange 93. A tubular extension 95 extends from the end of the flange 93 and has a ferrule 96 at one end thereof. A barrel 98 extends beyond the ferrule, the barrel being disposed in outer spaced concentric relation to a slotted end of the extension 94. An annular support block 100 is fixed within the slotted end of the extension 95 to receive a slidable guide 102 into which an extension pin 104 on the exposed end of the pin conductor P of the cable C is inserted. An internal shoulder on the inner surface of the guide limits the advancement of a leading end of the extension pin 104 to a point just short of the end of the barrel 98.

The inner and outer sleeves 91 and 92 are of the same configuration as the sleeves 12 and 18, respectively, of the embodiment of FIGS. 1 and 2 and are coextensive with one another but of increased length compared to the sleeves 12 and 18. As a result, the extension pin 104 facilitates insertion of the pin conductor P in centered relation to the connector body 90 as the cable is initially advanced into the connector 10 prior to the crimping operation, all as described in greater detail in U.S. Pat. No. 6,352,448 and incorporated by reference herein. Typically, the liner 48 is aligned with the outer sleeve 92, as illustrated in FIG. 16, so that the beveled end of the liner overlaps the entrance end of the sleeve 18. The cable C has its end prepared to expose the pin conductor P in accordance with well known practice, and the extension tip 104 is placed on the conductor pin P in order to guide the pin into the guide 102 prior to the initial movement of the outer braided layer B and jacket J into the crimping ring 44.

Figure 18:
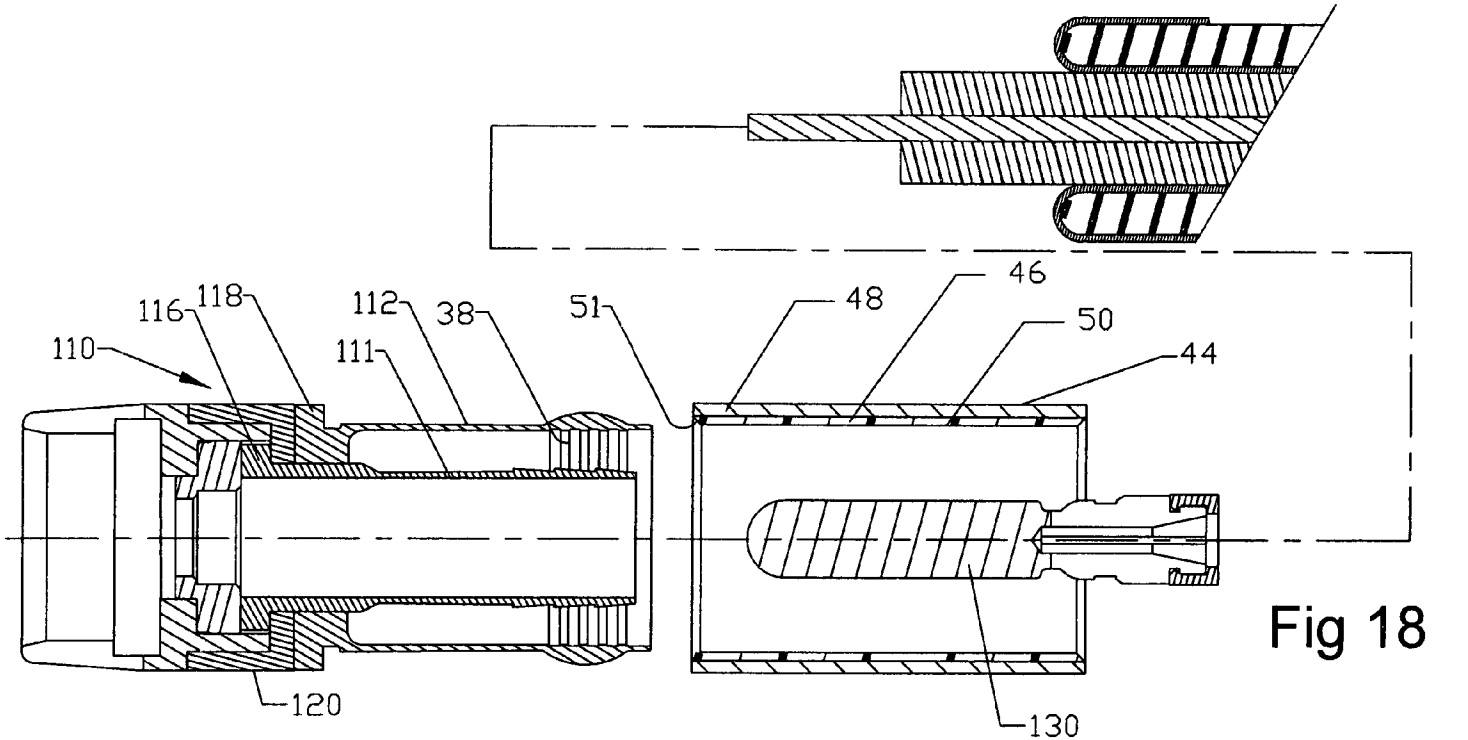
FIG. 18 is a longitudinal section view of an embodiment having an RCA connector prior to assembly of a compression member thereon.
Figure 19:
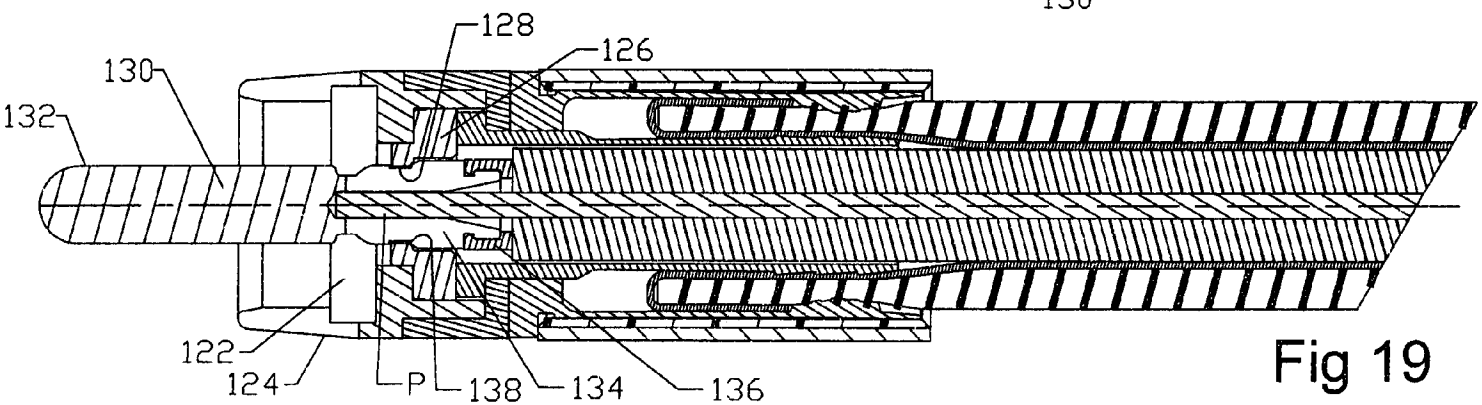
FIG. 19 is a longitudinal section view of the embodiment shown in FIG. 18 illustrated in the fully assembled or closed position.

FIGS. 18 and 19 illustrate utilization of the present invention with a standard RCA connector body 110 including inner and outer concentric sleeves 111 and 112 which are once again of the same configuration as the sleeves 12 and 18, respectively, in the embodiment of FIGS. 1 and 2. Also, the sleeve 112 is slightly longer than the inner sleeve 111 and both sleeves are of a length to insure that the sealing ribs 38 will be forced into engagement with the jacket J beyond the doubled over portion of the braided layer B. An extension pin 114 facilitates insertion of pin conductor P in centered relation to the connector body 110 as the cable is initially advanced into the connector body 110 prior to the crimping operation. Thus, the crimping ring 44 is preassembled onto the outer sleeve 112, as illustrated in FIG. 18, so that the beveled end 51 of the liner 46 slightly overlaps the entrance end of the sleeve 112.

The connector body 110 includes an annular mounting flange 116 at one end of the sleeve 111, and an external shoulder 118 at the end of the outer sleeve 112 is mounted on the flange 116 together with a keeper 120 which is mounted between the flange 116 and the shoulder 118. An annular base portion 122 of a ferrule 124 also bears against an annular guide member 126, the latter having an inner offset portion or shoulder 128 to receive an extension pin 130 at one end of the cable C.

The extension tip 130 is composed of a solid, elongated cylindrical metal body terminating in a rounded nose 132 at its leading end and a slotted end 134 surrounding a central opening at its opposite end which receives the pin conductor P. The slotted end 134 is affixed to the pin conductor P by inserting the end into a collar 136 which is affixed to the pin conductor P, and an external ridge or shoulder 138 extends circumferentially around an intermediate portion of the slotted end 134 and is dimensioned to move into abutting relation to the offset portion 128 on the guide 126 when the extension tip 130 and cable C are advanced through the connector body 110.

As a preliminary to the crimping operation, and with the crimping ring 44 being preassembled as earlier described, the cable C is advanced through the crimping ring 44 and the leading end or nose 132 of the extension tip 130 will initially engage the guide member 126 just prior to advancement of the outer braided layer B and jacket J into the space between the inner and outer sleeves 111 and 112. In the embodiments of FIGS. 12 to 19, the crimping operation is carried out in the same manner as described in reference to FIGS. 1 and 2 with a compression tool T illustrated in FIG. 11 and illustrated in more detail in U.S. Pat. No. 6,708,396 and incorporated by reference herein. Again, the jaws J1 and J2 are squeezed together to advance the compression member 44 over the convex bulge 36 whereby to radially deform or contract that portion of the sleeve 18 inwardly to cause the sealing ribs 38 to move into positive crimping engagement with the jacket J.

It will be appreciated from the foregoing that a greatly simplified form of termination assembly has been devised to effect localized sealed engagement of a connector body with an electrically conductive member, such as, a coaxial cable. One form of connector body having a bulge or convex surface portion on an external wall surface of its outer connector sleeve is adaptable for use in combination with a crimping ring having an inner wall-engaging surface of different configurations and yet achieve localized sealed engagement between the connector sleeve and cable inserted into the sleeve. The convex surface 36 of the connector sleeve may assume slightly different configurations, such as, ramped, slight interruptions or undulations in its external surface, and the embodiments illustrated are examples only. In general, the degree of convexity of the external convex surface portions 36 and 36' herein described will vary in accordance with the cable size. For example, a cable having a quad shield would require less thickness as well as length as emphasized in FIGS. 1 to 2. On the other hand, a universal-type connector which is designed for different cable sizes requires a thicker and longer convex surface portion 36, 36' with a greater number of sealing rings 38, 38' as exemplified in FIGS. 12 to 13. In addition, the depth and length of the convex surface portion 36, 36' may be readily adjusted for other reasons, such as, to increase or decrease the number and depth of the sealing rings or ribs 38, 38'.

In each form of invention, it is possible to exert the necessary pressure with a compression member having a selected inner diameter to compress the end portion of a sleeve on the connector portion of the assembly into sealed engagement with the outer surface of the cable in a rapid and highly efficient manner. The composition of the outer connector sleeve 18 preferably is a high strength metal material with sufficient malleability to undergo inward contraction along the convex surface portion 36 from an outwardly convex to inwardly convex configuration. Nevertheless, it will be appreciated that numerous other materials with corresponding malleability can be employed. Moreover, it will be appreciated that while a preferred composition of the compression rings 44, 44' and 44" is a combination of an inner plastic liner with an outer metal band that other materials with similar characteristics of the respective members can be employed.

It is therefore to be understood that while preferred forms of invention are herein set forth and described, the above and other modifications may be made therein without departing from the spirit and scope of the invention as defined by the appended claims and reasonable equivalents thereof.

I claim:

1. A cable termination assembly for connecting a cable having an electrically conductive member to another electrically conductive member comprising:

a connector body having a sleeve member of a generally cylindrical configuration, an end of said cable extending concentrically within said sleeve member, and said sleeve member having an external wall surface portion of generally convex configuration adjacent to one end thereof; and a cylindrical compression member having an inner annular surface slidable over said sleeve member, said inner annular surface portion engageable with said external wall surface portion of said sleeve member wherein axial advancement of said compression member along said sleeve member will impart inward radial deformation to said sleeve member and force an internal wall surface portion of said sleeve member into a radially inwardly bowed configuration as it contracts into engagement with an external surface portion of said cable.

2. A cable termination assembly according to claim 1 wherein said inner annular surface portion is of substantially uniform diameter.

3. A cable termination assembly according to claim 1 wherein said sleeve member is of increased thickness toward an entrance end thereof.

4. A cable termination assembly according to claim 1 wherein said inner annular surface portion includes a concave surface portion complementary to said convex surface portion.

5. A cable termination assembly according to claim 4 wherein said compression member includes an inner convex surface portion in axially spaced relation to said concave surface portion.

6. A cable termination assembly according to claim 1 wherein said compression member includes releasable locking means having a first locking member projecting radially inwardly from said compression member and a second complementary locking member projecting radially inwardly from an external wall surface of said sleeve member.

7. A cable termination assembly according to claim 1 wherein said compression member includes an inner concentric plastic crimp ring and an outer metal crimp ring.

8. A cable termination assembly according to claim 4 wherein said compression member has a plastic ring and an outer concentric metal ring partially overlying said plastic ring.

9. A cable termination assembly according to claim 8 wherein said inner concentric ring includes said concave and convex surface portions, and said outer concentric metal ring overlies said convex surface portion.

10. A cable termination assembly according to claim 1 wherein said inner annular surface includes an inner convex surface portion projecting radially inwardly therefrom whereupon axial advancement of said compression member along said sleeve member will cause said inner convex surface portion to impart inward radial deformation to said convex external surface into sealed engagement with an external surface portion of said cable.

11. A fitting for connecting a cable having an electrically conductive member to another electrically conductive member, said fitting comprising:

a thin-walled sleeve member of a continuous cylindrical configuration sized for axial insertion of an end of said cable therein, said sleeve member provided with an external convex surface portion thereon and internal sealing rings; and a cylindrical compression member having an inner concave annular surface portion adapted to overlie said external convex surface portion in preassembled relation to said sleeve member, and said compression member further having a first inner surface portion of substantially uniform diameter in trailing relation to said concave surface portion wherein axial advancement of said compression member along said sleeve member forces said first inner surface portion to move into engagement with said external convex surface portion will impart inward radial deformation to said sealing ribs into inwardly bowed configuration as said ribs are contracted into sealed engagement with said cable.

12. A fitting according to claim 11 wherein said compression member includes a second inner surface portion is of generally convex configuration.

13. A fitting according to claim 11 wherein said sleeve member is of uniform thickness throughout and has an entrance end, said external convex surface portion extending away from said entrance end for a distance corresponding to the length of said inner concave annular surface portion, and said sealing rings being axially spaced from one another and extending radially inwardly from said convex surface portion for a distance greater than the thickness of said sleeve member.

14. A fitting according to claim 13 including a first catch defined by a rib at a leading end of said compression member, and a second catch extending radially inwardly from a trailing end of said liner.

15. A fitting according to claim 12 wherein said compression member includes an inner liner having said inner concave annular surface portion and said first inner surface portion of uniform diameter and an outer concentric band overlying at least said first inner surface portion of uniform diameter.

16. A cable termination assembly for connecting a coaxial cable to a terminal wherein said cable has an outer resilient jacket, inner and outer spaced electrically conductive portions and wherein a connector body has a fastener for connection to said terminal and inner and outer concentric sleeve members with axially spaced sealing ribs on an inner surface of said outer sleeve member for insertion of said inner electrically conductive portion within said inner sleeve member and insertion of said outer electrically conductive portion between said inner sleeve member and said outer sleeve member, the improvement comprising:

said outer sleeve having a first external wall surface portion of a uniform diameter and a second external wall surface portion of generally convex configuration substantially coextensive with said sealing ribs; and an annular compression member having an inner liner of a substantially uniform diameter corresponding to said diameter of said first external wall surface portion wherein slidable axial advancement of said compression member with respect to said outer sleeve member will impart inward radial deformation to said external wall surface portion and force said axially spaced sealing ribs into inwardly bowed configuration as said ribs are contracted into sealed engagement with an external surface of said cable.

17. A cable termination assembly according to claim 16 wherein said compression member has a circular rib projecting radially inwardly from said liner.

18. A cable termination assembly according to claim 17 wherein said compression member has an outer concentric metal band.

19. A cable termination assembly according to claim 18 wherein said outer concentric metal band is axially slidable with respect to said liner.

20. A cable termination assembly according to claim 19 wherein said liner includes an inset portion to receive a leading end of said band having an inner diameter corresponding to the outer diameter of said inset portion, and said band including a thickened trailing end portion stepped inwardly from said leading end so as to be of a reduced inside diameter.

21. A cable termination assembly according to claim 20 wherein axial advancement of said band with respect to said liner causes said liner to advance from a position in which said thickened portion abuts an end of said liner to a closed position in which said leading end moves into engagement with said external shoulder on said liner.

22. In a connector for connecting a coaxial TV cable to a terminal wherein said cable has an outer resilient jacket, a dielectric layer, inner and outer spaced concentric electrically conductive portions, an extension tip on said inner spaced electrically conductive portion, and wherein said connector has a fastener for connection to said terminal and a body provided with an annular centering guide and inner and outer concentric sleeve members with axially spaced sealing rings on an inner surface of said outer sleeve member for insertion of said inner electrically conductive portion and dielectric layer within said inner sleeve member and insertion of said outer electrically conductive portion in said jacket between said inner and outer sleeve members, the improvement comprising:

said outer concentric sleeve member being of substantially uniform diameter and terminating in a generally convex surface portion projecting radially outwardly adjacent to an entrance end thereof, said sealing rings projecting radially and inwardly from said generally convex surface portion in axially spaced relation to one another; and a compression member having an inner annular surface portion of a diameter substantially corresponding to said outer sleeve member, and movable into surrounding relation to said entrance end of said outer sleeve member and whereupon axial advancement of said compression member along said outer sleeve member will impart inward radial deformation to said generally convex surface portion whereby to force said sealing rings into sealed engagement with said jacket after said extension tip has advanced into engagement with said centering guide.

23. In a connector according to claim 22 including a compression tool for axially advancing said compression member over said outer sleeve member.

24. In a connector according to claim 22 wherein said outer sleeve member is of uniform thickness throughout and increased in diameter adjacent to said entrance end to define said convex external wall surface portion.

25. In a connector according to claim 22 wherein said entrance end of said outer sleeve member is tapered away from said convex surface portion.

26. In a connector for connecting a coaxial TV cable to a terminal wherein said cable has an outer resilient jacket, a dielectric layer, inner and outer spaced concentric electrically conductive portions, an extension tip on said inner spaced electrically conductive portion, and wherein said connector has a fastener for connection to said terminal and a body provided with an annular centering guide and inner and outer concentric sleeve members with axially spaced sealing rings on an inner surface of said outer sleeve member for insertion of said inner electrically conductive portion and dielectric layer within said inner sleeve member and insertion of said outer electrically conductive portion in said jacket between said inner and outer sleeve members, the improvement comprising:

said outer concentric sleeve member being of substantially uniform diameter and terminating in a generally convex surface portion projecting radially outwardly adjacent to an entrance end thereof, said sealing rings projecting radially and inwardly from said generally convex surface portion in axially spaced relation to one another; and a cylindrical compression member having an inner concave annular surface portion adapted to overlie said external convex surface portion in preassembled relation to said sleeve member, and said compression member further having a first inner surface portion of substantially uniform diameter in trailing relation to said concave surface portion whereupon advancement of said extension tip into said centering guide and axial advancement of said compression member along said sleeve member will cause said first inner surface portion to move into engagement with said external convex surface portion to impart inward radial deformation to said sealing rings into sealed engagement with said cable.

27. In a connector according to claim 26 wherein said sleeve member is of uniform thickness throughout and has an entrance end, said external convex surface portion extending away from said entrance end for a distance corresponding to the length of said inner concave annular surface portion, and said sealing rings being axially spaced from one another and extending radially inwardly from said convex surface portion for a distance greater than the thickness of said sleeve member.

28. In a connector according to claim 26 including a first catch defined by a rib at a leading end of said compression member, and a second catch extending radially inwardly from a trailing end of said liner.

29. In a connector according to claim 28 wherein said rib is composed of a material of limited resiliency which will compress as it advances along said outer convex surface portion and will expand after it clears said external shoulder.

30. In a connector according to claim 26 wherein said sleeve member includes a thin-walled portion extending between said entrance end and said convex surface portion.

31. In a connector according to claim 26 wherein said compression member includes an inner liner having said inner concave annular surface portion and said first inner surface portion of uniform diameter and an outer concentric band overlying at least said first inner surface portion of uniform diameter.

* * * * *